US006771923B2

(12) United States Patent
DeYoung et al.

(10) Patent No.: US 6,771,923 B2
(45) Date of Patent: Aug. 3, 2004

(54) MAGNETIC CORE FOR USE IN A DEVELOPMENT SYSTEM

(75) Inventors: Victoria F. DeYoung, Webster, NY (US); Dale R. Mashtare, Bloomfield, NY (US); Fei Xiao, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/321,970

(22) Filed: Dec. 17, 2002

(65) Prior Publication Data

US 2004/0114970 A1 Jun. 17, 2004

(51) Int. Cl.[7] ..... G03G 15/09
(52) U.S. Cl. ..... 399/277
(58) Field of Search ..... 399/267, 270–277

(56) References Cited

U.S. PATENT DOCUMENTS 4,690,096 A 9/1987 Hacknauer et al. ..... 118/657
5,227,848 A 7/1993 Robinson et al.
5,409,791 A 4/1995 Kaukeinen et al. ..... 430/54
5,758,242 A * 5/1998 Malespin et al. ..... 399/277
5,890,041 A 3/1999 Lewis ..... 399/276
5,926,676 A 7/1999 Snelling et al. ..... 399/267
5,946,534 A 8/1999 Lewis ..... 399/272
6,421,519 B1 * 7/2002 Yamashita et al. ..... 399/277

* cited by examiner

*Primary Examiner*—William J. Royer

(57) ABSTRACT

A magnetic core includes an array of permanent magnets bonded to a cylindrical core. The magnets are formed of an extruded magnetic composite material containing a neodymium-boron-iron alloy. The magnetic core contains regions of alternating magnetic polarization arranged to create a multipole structure. Such extruded magnets easily constructed at low cost and offer close magnetic pole spacing with little or negligible surface discontinuity.

9 Claims, 4 Drawing Sheets

MAGNETIC CORE FOR USE IN A DEVELOPMENT SYSTEM

This invention relates generally to an electrophotographic printing machine and, more particularly, to a development system for development of electrostatic images.

An electrophotographic printing machine includes a photoconductive member which is charged to a substantially uniform potential to sensitize the surface thereof. The charged portion of the photoconductive member is exposed to an optical light pattern representing a document being produced. This records an electrostatic image on the photoconductive member corresponding to the informational areas contained within the document. After the electrostatic image is formed on the photoconductive member, the image is developed by bringing a developer material into effective contact therewith. Typically, the developer material comprises toner particles bearing electrostatic charges chosen to cause them to move toward and adhere to the desired portions of the electrostatic image. The resulting physical image is subsequently transferred to a copy sheet. Finally, the copy sheet is heated or otherwise processed to permanently affix the powder image thereto in the desired imagewise configuration.

Development may be interactive or non-interactive depending on whether toner already on the image may or may not be disturbed or removed by subsequent development procedures. Sometimes the terms scavenging and non-scavenging are used interchangeably with the terms interactive and non-interactive. Non-interactive development is most useful in color systems when a given color toner must be deposited on an electrostatic image without disturbing previously applied toner deposits of a different color, or cross-contaminating the color toner supplies.

In the prior art, both interactive and non-interactive development have been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to improve developer adhesion. The rotation of the sleeve transports magnetically adhered developer through a development zone where there is direct contact between the magnetic brush and the imaged surface, and toner is stripped from the passing magnetic brush filaments by the electrostatic fields of the image.

U.S. Pat. No. 5,409,791 to Kaukeinen et al., the disclosure of which is hereby incorporated by reference, describes a non-interactive magnetic brush development method employing permanently magnetized carrier beads operating with a rotating multipole magnet within a conductive and nonmagnetic sleeve. Magnetic field lines form arches in the space above the sleeve surface and form chains of carrier beads. The developer chains are held in contact with the sleeve and out of direct contact with a photoreceptor by gradients provided by the multipole magnet. As the magnet rotates in one direction relative to the sleeve, the magnetic field lines beyond the sleeve surface rotate in the opposite sense, moving carrier bead chains in a tumbling action which transports developer material along the sleeve surface. The strong mechanical agitation effectively dislodges toner particles generating a rich powder cloud which can be developed to the adjacent photoreceptor surface under the influence of development fields between the sleeve and the electrostatic image. However, such radial flow of developer material occurs over the full surface of the sleeve; hence, a stripping device such as a skiving blade must be included for removing spent developer before it returns to the development zone.

U.S. Pat. No. 5,227,848 to Robinson et al. describes a toning roll assembly in which a rotatable core member with magnetic poles disposed about the periphery thereof is positioned within a hollow shell so that the shell-to-core clearance, and therefore, the magnetic field strength on the outside surface of the shell varies from point-to-point on the shell. Magnetically attractable developer particles are fed onto the shell's surface at a point in a loading zone of higher field strength and moved through a point of lower field strength on the shell. The field strength is provided solely by the rotatable core member, which, although positioned eccentrically with respect to the shell, must be positioned so as .to attract and support a requisite amount of developer material on the shell.

As illustrated in FIG. 1, it may be observed that the provision of agitated bead chains according to the foregoing two patents will result in linear ridges, or "piles", of developer material distributed about the developer sleeve 100 due to the high density of bead chains approximately at the midpoint of each magnet 120. (Corresponding valleys, or "troughs", of developer material thus locate at the intersections of adjacent magnets 120.) As a consequence of this effect, the resulting developer chains accumulate over the developer roll in linear piles having varying peaks and troughs that are arranged in parallel to the central longitudinal axis of the magnetic developer roll.

In typical practice, the magnetic developer roll is operated with associated devices, such as a skiving blade, that engage the developer sleeve 100 in order to remove unused developer and toner material from the developer sleeve 100. Similar devices may be located adjacent the developer sleeve 100 to meter fresh developer material onto the developer sleeve 100 so as to effect replenishment of fresh developer material. In typical practice, such blades are oriented in parallel with the same central longitudinal axis of the magnetic developer roll.

In conceiving the present invention, I have found that the above-described development systems suffer from the following undesirable phenomena.

The magnetic brush height formed by the developer mass in the magnetic fields on the sleeve surface in the aforementioned types of development systems is periodic in thickness and is statistically noisy as a result of complex carrier bead agglomeration and filament exchange mechanisms that occur during operation. Accordingly, substantial clearance must be provided in the development gap to avoid photoreceptor interactions through direct physical contact. The use of a closely spaced developer layer, which is critical to high fidelity image development, is precluded.

The magnetic pole spacing cannot be reduced to an arbitrarily small size because allowance for the thickness of the sleeve and a reasonable mechanical clearance between the sleeve and the rotating magnetic core sets a minimum working range for the magnetic multipole forces required to both hold and tumble the layer of developer material on the sleeve. Since the internal pole geometry defining the spatial wavelength of the tumbling component also governs the magnitude of the holding forces for the developer material at any given range, there is limited design freedom available to satisfy the opposing system requirements of short spatial wavelength and strong holding force.

Relative rotation of the magnetic developer roll and the developer sleeve will rotate successive ones of the magnets within the developer sleeve and thus under the engaging edge of the skiving blade. A corresponding movement of successive linear piles of developer material move along the exterior of the developer sleeve. As a result, the skiving blade will periodically be impacted by the entire length of a linear pile of developer material, whereupon the development system undergoes substantial increase in mechanical stress, which is periodic due to the rapid succession of developer pile masses encountered by the skiving blade. During each stress peak, the skiving blade, magnetic developer roll, developer material, along with the motor drive and any respective mechanisms including motor drive bearings, will experience a significant increase in mechanical force. The motor drive also undergoes a significant peak demand for drive torque. Additional undesirable effects include a likelihood of vibration in the system, an increase in imaging artifacts due to motion disturbances, degradation of the carrier and toner (presumably due to the pile/blade impact), and a propensity for temporal and spatial variations in the efficiency of the skiving blade. Such a skiving blade can become contaminated and thus falter, and developer additives are required to keep it clean. Such skiving action can also abrade both the skiving blade and the developer sleeve. The magnetic developer roll can also become impractical when constructing a wide body configuration (e.g., a roll length that exceeds approximately 17 inches), as the aforementioned mechanical stress can be expected to increase dramatically as the magnetic developer roll increases in length.

The tumbling action that occurs over the full extent of the developer sleeve also promotes toner particle dispersion in regions outside of the development zone, which causes unwanted contamination of the electrophotographic system.

The present invention obviates the problems noted above by providing a development system that employs a magnetic developer roll featuring an offset magnetic core operable for relative rotation within a developer sleeve. The magnetic core includes a plurality of magnetic core pole segments that are tightly arranged on the magnetic core in an alternating pole pattern. The magnetic core is offset from the central longitudinal axis of the developer roll. Accordingly, and in a principal feature of the invention, the magnetic field gradient of the magnetic core influences a portion of the developer material layer most proximate to the magnetic core, and accordingly the peaks and troughs of the agitated developer material formed on the developer sleeve are confined to a portion of the circumference of the developer sleeve. In preferred embodiments, the magnetic core is sufficiently offset from the central longitudinal axis of the developer roll such that agitation is substantially confined to a portion that is proximate to and within a development zone located adjacent the magnetic core and between the sleeve and the photoreceptor.

The contemplated development system is thus optimized for localized agitation of developer material proximate to and within the development zone, and thereby offers cleaner and more efficient development of an electrostatic latent image on an imaging surface. The development system includes a development material sump, a magnetic developer roll having a rotatable sleeve enclosing an offset magnetic core, and a developer material delivery system for providing a metered supply of developer material. One or more stationary magnets located within the sleeve provide a static magnetic field pattern effective for attracting developer material to the sleeve and for aiding transport of the developer material therefrom to the development zone.

In operation, a metering device provides a supply of fresh development material from a sump to a loading zone at the sleeve. A stationary magnet located within the sleeve and proximate to the loading zone attracts and forms a thin, pre-defined layer of developer material on the sleeve exterior surface. The rotating developer roll generates a magnetic field to move the layer of developer material along the sleeve exterior surface to the development zone, where a portion of the layer is agitated, that is, the portion of the layer of developer material proximate to the magnetic core and thereby subject to the magnetic field gradient of the magnetic core. The toner particles are dislodged from the carrier beads to aid in the formation of a toner cloud in the development zone. Continued rotation of the sleeve brings the layer of developer material to a drop-off zone where the magnetic field has declined sufficiency to allow the developer material to fall from the sleeve into the sump.

Accordingly, the rotatable magnetic core need not be designed for transporting toner from the loading zone to the development zone, and may be optimized for a particular developer layer height and agitation, for more efficient development of a latent image. A preferred embodiment of a compact magnetic core may be constructed for location between the central longitudinal axis of the magnetic developer roll and the interior wall of the sleeve. The extent of the magnetic field of the magnetic developer roll is then localized so as to substantially confine the agitation of the developer material to the development zone. Additional benefits include: extended operating latitudes, improved development efficiency, and reduced toner dispersion away from the development zone.

Furthermore, a developer material stripping device is no longer necessary, because spent developer material falls from the sleeve at the drop-off zone. The contemplated development system thereby experiences a smoother rotational operation, and a significant reduction in the mechanical forces and stresses described above, along with a concomitant reduction in vibration, imaging artifacts, carrier and toner degradation, and other deficiencies in the performance of the system.

Thus, a development system constructed according to this invention is not only robust but also permits use of less costly components, such as a compact magnetic core, and a motor drive of lower drive torque.

An apparatus for non-interactive development of electrostatic images may be constructed to include an image bearing member bearing an electrostatic image; two-component developer material comprising toner and hard magnetic (permanently-magnetized) carrier beads, a magnetic developer roll including a stationary magnet, a rotatable magnetic core having multiple pole segments, and a cylindrical developer transporting sleeve enclosing and rotating about the rotatable magnetic core and the stationary magnet.

In a particular feature of the present invention, the sleeve exhibits a uniform, predefined sleeve radius and the magnetic core is substantially located within the sleeve radius, that is, the diameter of the magnetic core substantially fits between the central longitudinal axis of the magnetic developer roll and the interior surface of the sleeve. In certain embodiments, the diameter of the magnetic core may be a fractional amount of the sleeve radius. Accordingly, the magnetic core is optimally located for agitating a portion of the developer layer of the two component developer material, the agitated portion being spaced close to but not contacting with the image bearing member. Thus, the developer layer is transported about the sleeve substantially without agitation except when proximate to and within the development zone, where it is advantageously subject to agitation induced by the field gradients provided by the magnetic core.

In another feature of the present invention, the layer of developer material will progress from the loading zone through the development zone to a drop-off zone. This feature is useful in system designs which require, for example, an input of developer material into the development system housing at one side with a subsequent output of developer material at the opposing side of the development system housing.

In another feature of the invention, a development system for developing an image with developer material may be constructed in a more compact unit wherein the magnetic developer roll includes the novel offset arrangement of a compact magnetic core and stationary magnet, and a cylindrical sleeve enclosing and rotating about the magnetic core and stationary magnet.

In another feature of the invention, an imaging system for providing image-on-image, non-interactive development of electrostatic images may be constructed to include an image bearing member bearing an electrostatic image; a housing containing developer material, a magnetic developer roll for transporting the developer material from the housing to the image, wherein the magnetic developer roll includes the novel offset arrangement of magnetic core pole segments in the magnetic core, and a cylindrical sleeve enclosing and rotating about the magnetic core.

Embodiments of the present invention are both robust and permit a spacing between a development system and the electrostatic image that is small enough to eliminate or significantly reduce image defects associated with fine lines and edges.

detailed description of the exemplary embodiments may now be understood with reference to the Figures. Although the present invention will now be described in connection with one or more embodiments, such description is not intended to be so limited. On the contrary, it is intended to cover all alternatives, modifications, and equivalents as may be included within the spirit and scope of the invention as defined by the appended claims. In the following description, usage of like reference numerals will designate Identical elements. The disclosure of U.S. Pat. No. 5,946,534; entitled, "APPARATUS AND METHOD FOR NON-INTERACTIVE ELECTROPHOTOGRAPHIC DEVELOPMENT" is hereby incorporated by reference.

Figure 1:
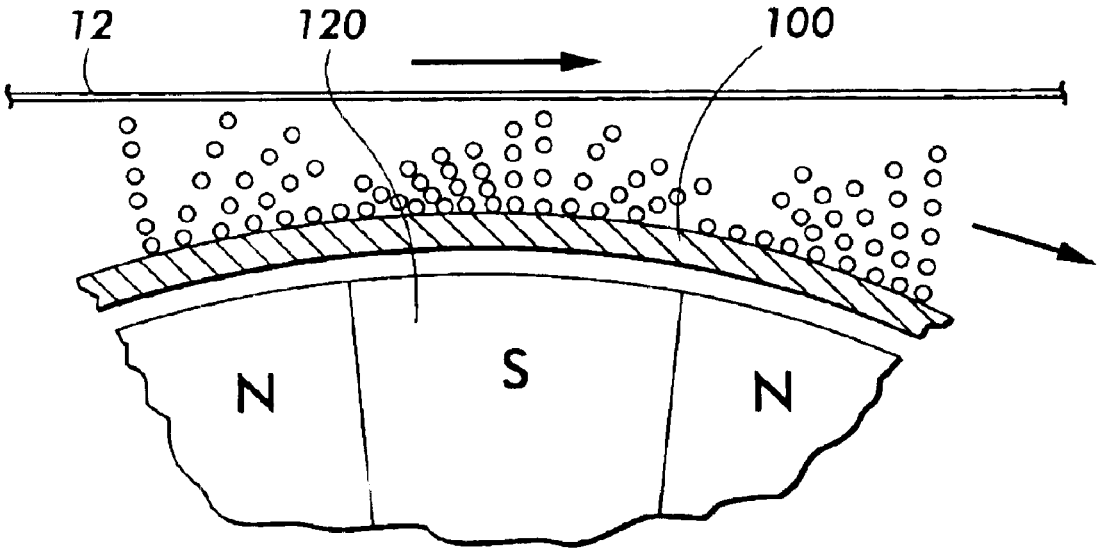
FIG. 1 PRIOR ART
FIG. 1 is a partial side view of a prior art development system.
Figure 2:
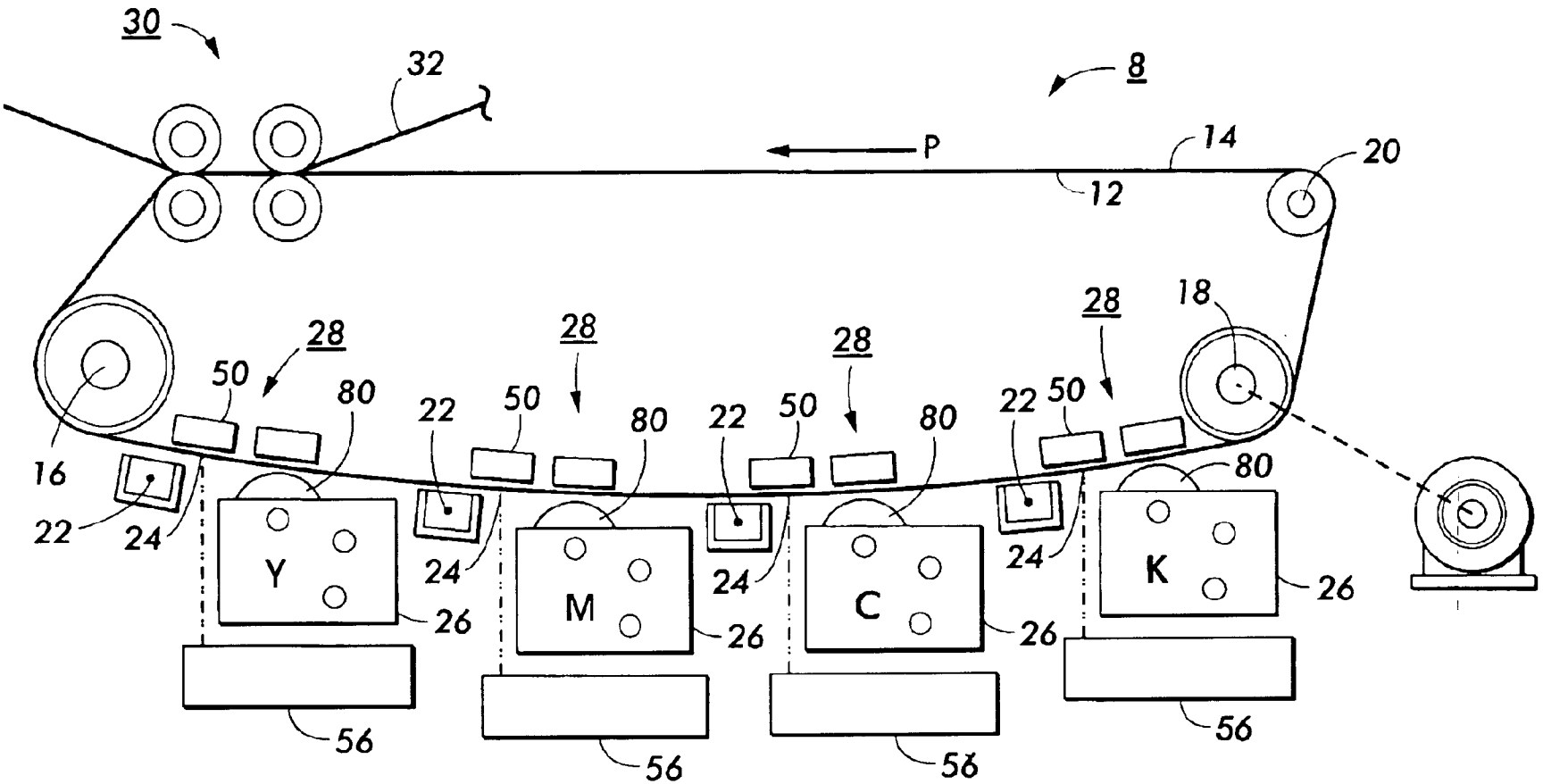
FIG. 2 is a side view, in section, of a four color xerographic reproduction machine incorporating the development system of the present invention.
Figure 3:
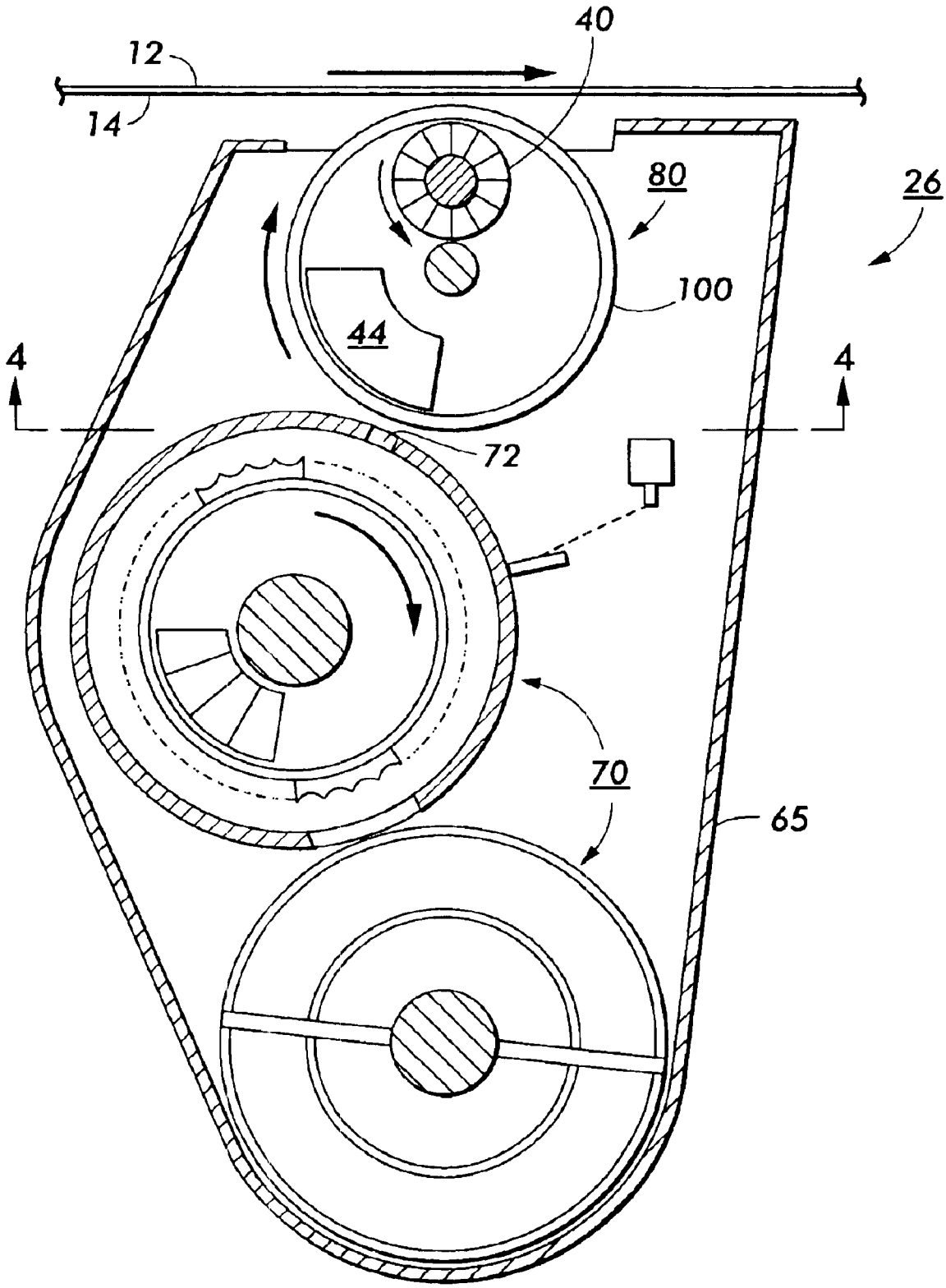
FIG. 3 is an enlarged side sectional view of the system of FIG. 2.

Referring to FIGS. 2 and 3 of the drawings, there is shown a xerographic type reproduction machine 8 incorporating an embodiment of the development system of the present invention that includes a magnetic developer roll designated generally by the numeral 80. Machine 8 has a suitable frame (not shown) on which the machine xerographic components are operatively supported. As will be familiar to those skilled in the art, the machine xerographic components include a recording member, shown here in the form of a translatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer station 30, the direction of movement being counter-clockwise as viewed in FIG. 2 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at transfer station 30. In preparation for the next imaging cycle, unwanted residual toner is removed from the belt surface at a cleaning station (not shown). Following transfer, the copy sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A raster output scanner (ROS) 56 generates a closely spaced raster of scan lines on photoconductive surface 14 as photoreceptor 12 advances at a constant velocity over shoe 50. At each exposure station 24, a ROS 56 exposes the charged photoconductive surface 14 point by point to generate the electrostatic image associated with the color separation to be generated. It will be understood by those familiar with the art that alternative exposure systems for generating the electrostatic images, such as print bars based on liquid crystal light valves and light emitting diodes (LEDs), and other equivalent optical arrangements could be used in place of the ROS systems such that the charged surface may be imagewise discharged to form an electrostatic image of the appropriate color separation at each exposure station 24.

Developer assembly 26 includes a developer housing 65 in which a toner dispensing cartridge (not shown) is rotatably mounted so as to dispense toner particles downward into a sump area occupied by the auger mixing and delivery assembly 70 as taught in U.S. Pat. No. 4,690,096 to Hacknauer et al which is hereby incorporated by reference.

Continuing with the description of operation at each development station 28, the magnetic developer roll 80 is disposed in predetermined operative relation to the photoconductive surface 14 of photoreceptor 12, the length of magnetic developer roll 80 being equal to or slightly greater than the width of photoconductive surface 14, with the central longitudinal axis of magnetic developer roll 80 being parallel to the photoconductive surface 14 and oriented at a right angle with respect to the path of photoreceptor 12. Advancement of magnetic developer roll 80 carries the layer of developer material into the development zone in proximal relation with the photoconductive surface 14 of photoreceptor 12 to develop the electrostatic image therein. A suitable controller is provided for operating the various components of machine 8 in predetermined relation with one another to produce full color images containing Y, M, C, K colored toner.

Figure 4:
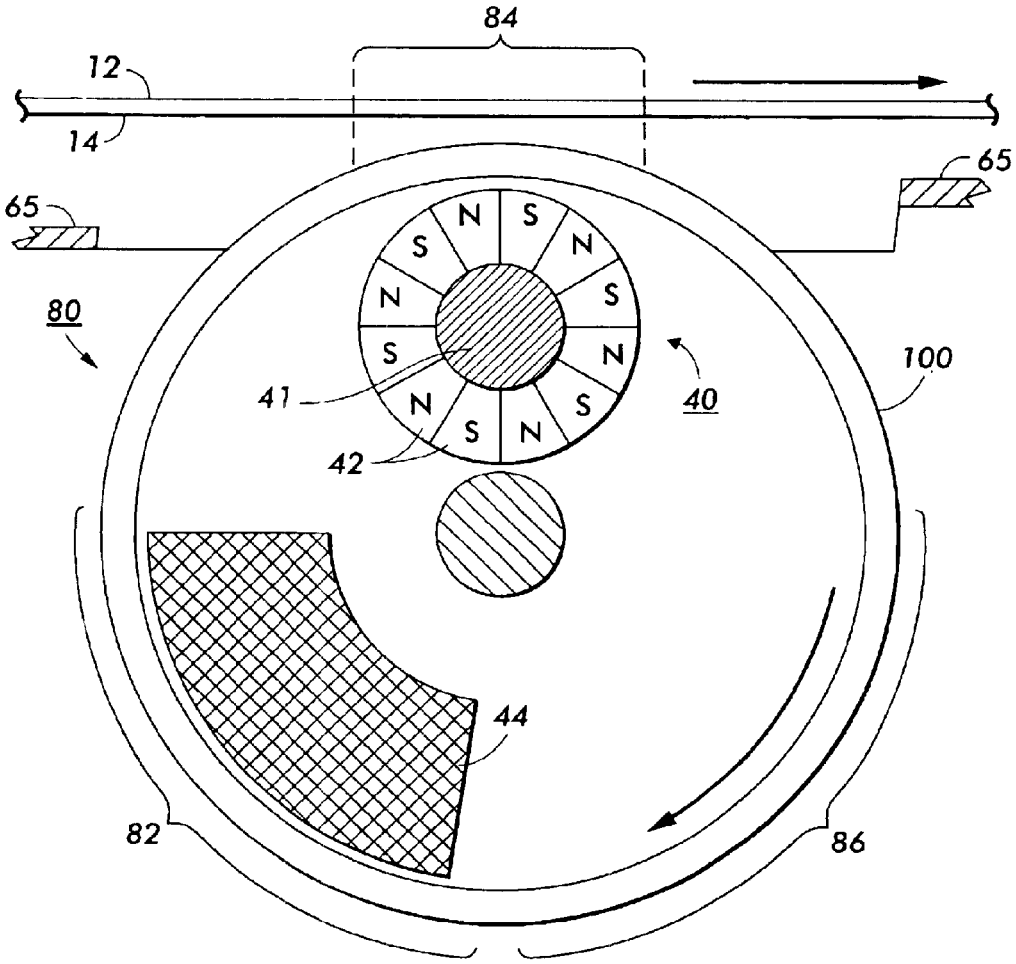
FIG. 4 is an enlarged side sectional view of a magnetic developer roll shown in FIG. 3.

FIGS. 3 and 4 show the photoreceptor 12, a rotatable sleeve 100, and a magnet assembly including a magnetic core 40 and stationery magnet 44. As shown in FIG. 4, the developer roll 80 is constructed to operate according to a developer material loading zone 82, a development zone 84, and a developer material drop-off zone 86. The gap between the photoconductive surface 14 of photoreceptor 12 and the surface of the sleeve 100 is in the range of about 300 to 800 microns.

The magnetic core 40 includes an array of permanent magnets 42 bonded to a cylindrical core 41 of iron or other soft magnetic material. The magnetic core 40 contains regions of alternating magnetic polarization arranged to create a multipole structure. Preferably the density of magnetization is a pure sinusoid with a period of about 6 to 10 mm and the magnetic core 40 has a pole spacing of about 3 to 5 mm.

Sleeve 100 and magnetic core 40 are made to rotate relative to one another by suitable mechanical means. Preferably sleeve 100 is also rotated by these means relative to developer housing 65. The relative motion of sleeve 100 and magnetic core 40 generate a rotating magnetic drive field (not shown) in a reference frame fixed to the surface of 100. A supply of developer material layer is passed from a metering slot 72 and attracted to the surface of sleeve 100 under the influence of the stationary magnet 44. Rotation of the sleeve 100 transports the developer material layer into and through the development zone 84. A portion of the developer material layer that is proximate to magnetic core 40 is subject to a magnetic field gradient such that the agitation is substantially confined to the development zone 84. Preferably, the developer material layer is prevented from contacting photoconductive surface 14 by the gradient in the magnetic field generated by the magnetic core 40. Improved, non-interactive development of a latent image on the photoconductive surface 14 occurs in the development zone 84.

In preferred embodiments, the developer material layer may comprise a thickness in the range of 250 to 500 microns. The developer material layer includes a mixture of magnetic carrier particles, of diameter ranging from 10 to 100 micron, and toner particles, ranging in diameter from 1 to 15 microns.

Preferred examples of the magnetic core 40 are contemplated as containing magnets formed of an extruded magnetic composite material containing at least 60% by volume of neodymium-boron-iron hard magnet alloy. Such extruded magnets are more easily constructed in the illustrated keystone shape, and at lower-cost, than may be obtained with conventional sintered hard ferrite magnets, and offer tighter magnetic pole spacing with little or negligible surface discontinuity. Additionally, such magnets may be extruded according to the requisite form factor so as to be exactly shaped without further machining. These magnets may be precisely assembled without gaps to form a magnetic core 40 in a compact cylindrical form that nonetheless offers multiple, very closely-spaced magnetic poles of high magnetic field strength.

The development system described herein is useful for interactive and non-interactive development, depending on whether the toner already on the image may or may not be disturbed or removed by subsequent development procedures.

The terms "reprographic" or "reproduction" apparatus, "printing" or "printer", as used herein, broadly encompasses various printers, copiers, or multifunction machines or systems, electrographic and electrostatographic or otherwise, unless otherwise defined in a claim; The term "sheet" herein refers to a generally planar segment of paper, plastic, or other suitable physical substrate amenable to receiving a developed image, whether precut or web fed.

As to specific components of the subject apparatus or methods; or alternatives therefor, it will be appreciated that such components are optional if so designated, and if such components are known per se in other apparatus or applications, other versions may be additionally or alternatively used, especially those from prior art cited herein. All references cited in this specification, and their references, are incorporated by reference herein where appropriate for teachings of additional or alternative details, features, and/or technical background.

What is claimed is:

1. A magnetic core for use in a development system for developing an image, the development system including a magnetic developer roll for transporting developer material, the magnetic core being comprised of a plurality of magnets of alternating polarities arranged with respect to a central longitudinal axis of the magnetic core, and the magnets being formed of an extruded, composite material containing a neodymium-boron-iron alloy.

2. The magnetic core of claim 1, wherein the extruded composite material further comprises at least 60% by volume of neodymium-boron-iron alloy.

3. The magnetic core of claim 1, wherein the magnets are permanently magnetized.

4. The magnetic core of claim 1, wherein the magnets are extruded in a keystone shape and bonded together about a common core of soft magnetic material to form a cylindrical assembly.

5. A development system for developing an image with developer material, comprising:

a housing containing the developer material; and a magnetic developer roll for transporting the developer material from the housing to the image, the magnetic developer roll including a magnetic core and a sleeve enclosing the magnetic core, wherein at least one of the sleeve and magnetic core being rotatable for providing relative rotation;

wherein the magnetic core includes a plurality of magnets of alternating polarities arranged with respect to a central longitudinal axis of the magnetic core, and the magnets being formed of an extruded composite material containing a neodymium-boron-iron alloy.

6. The development system of claim 5, wherein the extruded composite material further comprises at least 60% by volume of neodymium-boron-iron alloy.

7. The development system of claim 5, wherein the magnets are permanently magnetized.

8. The development system of claim 5, wherein the magnets are extruded in a keystone shape and bonded together about a common core of soft magnetic material to form a cylindrical assembly.

9. The development system of claim 5, wherein the developer material further comprises hard magnetic carrier beads.

* * * * *